US006957983B1

(12) United States Patent
Lai

(10) Patent No.: US 6,957,983 B1
(45) Date of Patent: Oct. 25, 2005

(54) MONITORING MODULE OF MULTI-CARD CONNECTOR

(75) Inventor: Yaw-Huey Lai, Taipei (TW)

(73) Assignee: Taisol Electronics Co., Ltd., Taipei (TW)

( * ) Notice: Subject to any disclaimer, the term of this patent is extended or adjusted under 35 U.S.C. 154(b) by 0 days.

(21) Appl. No.: 10/905,866

(22) Filed: Jan. 25, 2005

(51) Int. Cl.[7] ..... H01R 24/00
(52) U.S. Cl. ..... 439/630; 439/488; 439/924.1
(58) Field of Search ..... 439/488–490, 439/630, 924.1

(56) References Cited

U.S. PATENT DOCUMENTS 5,641,295 A * 6/1997 Koyama ..... 439/326
6,126,486 A * 10/2000 Chang ..... 439/630
6,719,577 B2 * 4/2004 Nogami ..... 439/188
6,830,474 B2 * 12/2004 Liu et al. ..... 439/489

* cited by examiner

*Primary Examiner*—Gary Pauman
*Assistant Examiner*—James R. Harvey

(57) ABSTRACT

A monitoring module of a multi-card connector includes a electrically insulative housing comprising a base; a monitoring module; two side arms respectively extending from the base at two sides in same direction; a receiving space defined between two side arms for receiving a memory card; a sliding member disposed in the receiving space and having at least one sliding surface; a common terminal and a contact terminal, being fixed respectively to the sliding member and the side arm nearby; and the common terminal includes at least one contact member, thereby after a memory card is inserted into the housing, the memory card moves the sliding member towards inward horizontally through the pushing surface, and the contact member of the common terminal is electrically connected with the corresponding contact terminals in sequence as to concurrently achieve the objectives of detecting a circuit connection, a memory card installation and a write protect function.

4 Claims, 8 Drawing Sheets

MONITORING MODULE OF MULTI-CARD CONNECTOR

BACKGROUND OF THE INVENTION

1. Field of the Invention

The present invention relates to a monitoring module of a multi-card connector, more particularly to a monitoring module capable of concurrently detecting a circuit connection, a memory card installation and a write-protect function by monitoring the electric connection between a common terminal and a contact terminal when a memory card is plugged into a electrically insulative housing.

2. Description of Related Art

As the flash memory was introduced to the market, its charming features including the powerful computational capability, high speed, high expandability and high storage density gradually replace the electrically erasable programmable read only memory (EEPROM) or the battery-driven memory in most portable devices. At the present, the semiconductor technology advances rapidly, the storage density and transmission speed of the flash memory grow drastically. Therefore, flash memories have replaced traditional storage media such as hard disk drives in many applications. With the foregoing functions and features of the flash memory, related manufacturers adopt flash memories to develop various kinds of memory cards, such as the typical personal computer memory card international association (PCMCIA) memory card, and the present common memory cards also include the specifications of a multimedia card (MMC), a compact flash card (CF), a smart media card (SMC), a memory stick (MS), a secure digital memory card (SD), and an xD-Picture card. These types of memory cards become very popular and extensively acceptable by consumers since their introduction to the market. Now, flash memories have become an indispensable tool, and the demand for card connectors is getting higher accordingly.

In addition, a traditional positioning structure for a memory card and a card connector fixes the connector onto a circuit board and then inserts the memory card into the card connector as to achieve the effect of electrically connecting the memory card with the card connector. However, if the memory card is not inserted all the way to the fixing point of the connector or gets loosened due to an improper contact or a collision by an external force, it will easily lead to a misjudgment on determining whether or not the memory card is electrically connected to the connector. Therefore, the signals cannot be transmitted successfully due to a poor contact or a disconnection, and the reading data may be lost. Furthermore, some electronic cards come with a write/read switch that facilitates users to switch to write protect the data stored in a memory card or prevent users from modifying the data in a memory card. Thus, some related manufacturers developed various kinds of card connectors having the functions of detecting a circuit connection, a memory card installation and a write-protect function. These card connectors generally includes a plurality of detecting terminal sets installed in a card connector for detecting the foregoing functions, and each detecting terminal set comes with two corresponding terminals to constitute an electric connection, and thus the design of the card connector requires a certain space therein, and the overall size of the card connector cannot be reduced effectively. For the manufacture of the detecting terminal sets, it requires at least two molds, and thus increasing the manufacturing cost of the card connector. Furthermore, since the science and technology grows rapidly, the design of related electronic products tends to have a light, thin, short and compact appearance, and the size of the card connector must be taken into serious consideration. Therefore, it is a very important issue for a card connector designer to reduce the space occupied within the card connector as to reduce the overall size of the connector.

SUMMARY OF THE INVENTION

The present invention has been accomplished under the circumstances in view. Therefore, it is a primary objective of the present invention to simplify the two detecting terminals of the plurality of detecting terminal sets according to the prior arts, and makes use of the electric connection of an integrally formed common terminal with each contact terminal in sequence to provide the functions of detecting an electric connection, a memory card installation and a write-protect function concurrently for the common terminals as to reduce the space occupied by the extra terminal sets in the electrically insulative housing and further reduce the overall size of the card connector. The invention also makes the mass production of the integrally formed common terminals easier, and thus lowering the manufacturing cost of the card connector.

DETAILED DESCRIPTION OF THE PREFERRED EMBODIMENTS

Figure 1:
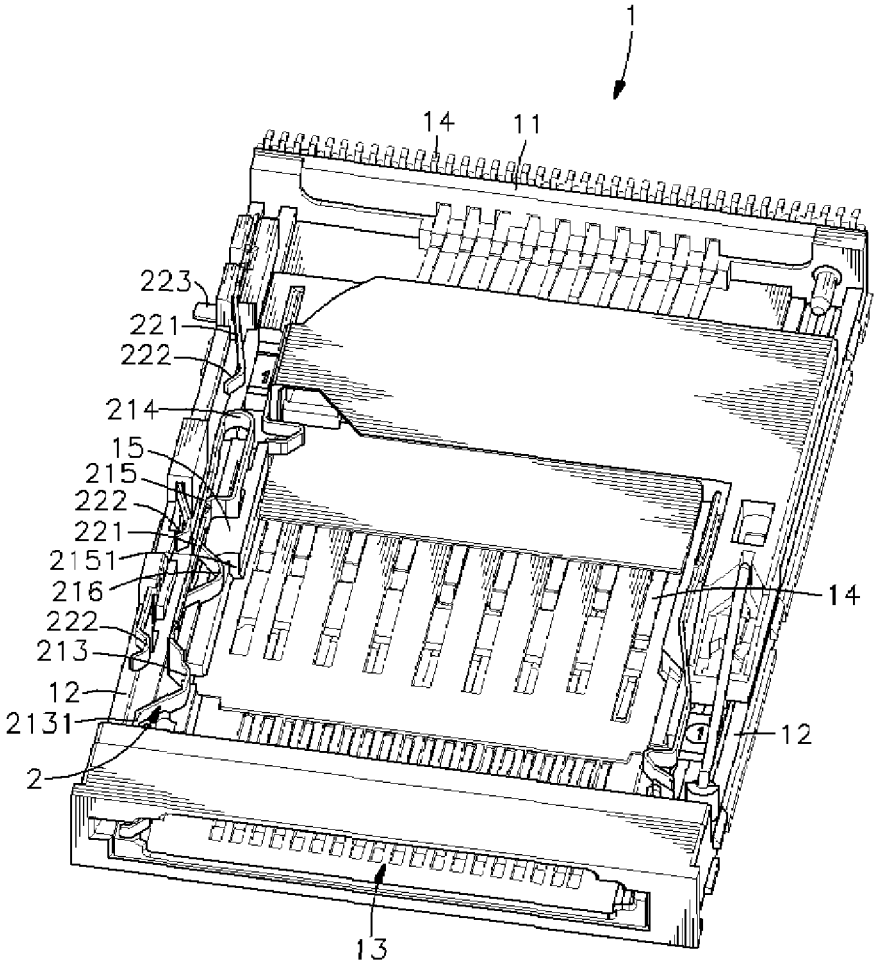
FIG. 1 is a perspective view of the present invention.
Figure 2:
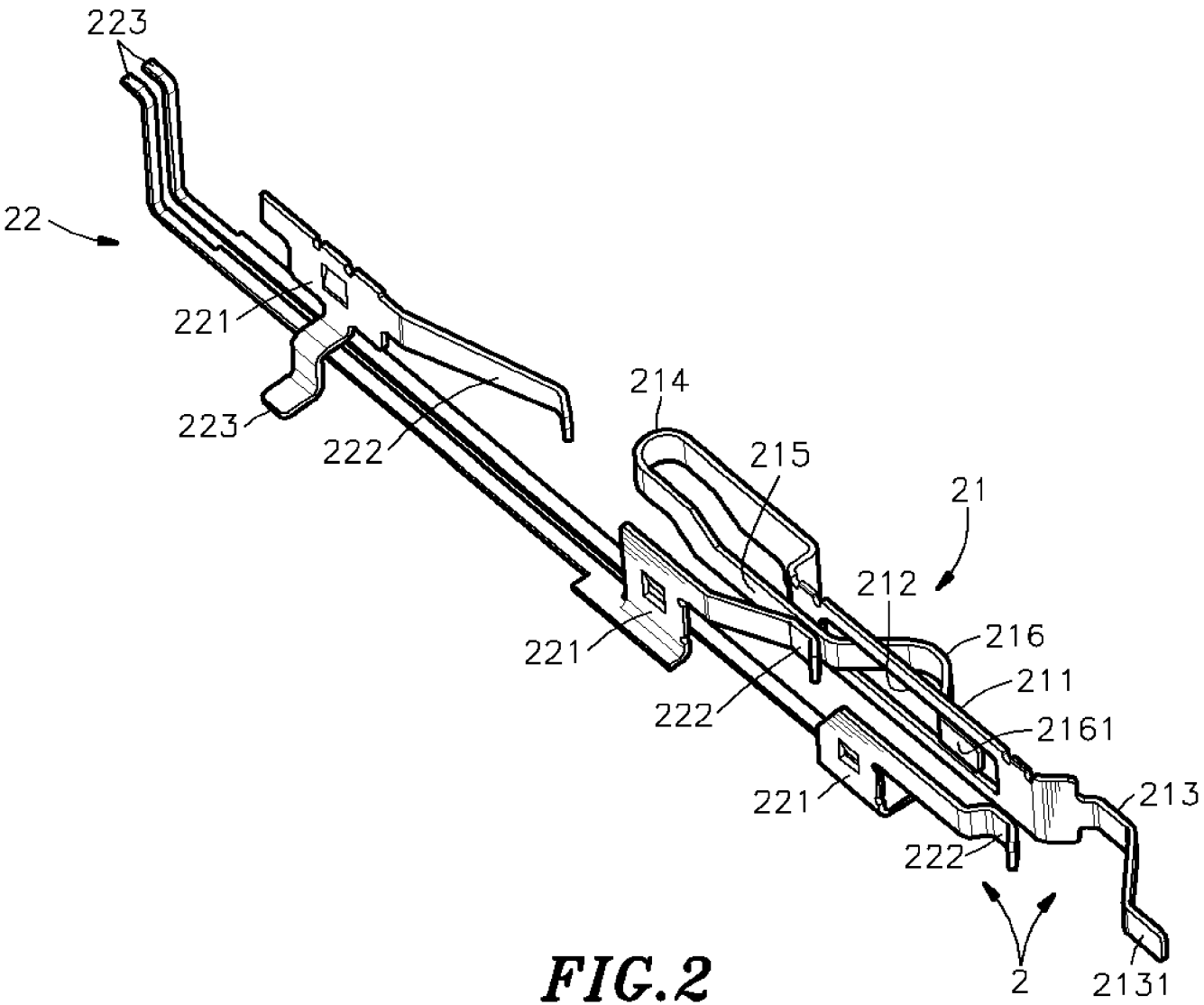
FIG. 2 is a perspective view of a monitoring module according to the present invention.
Figure 3:
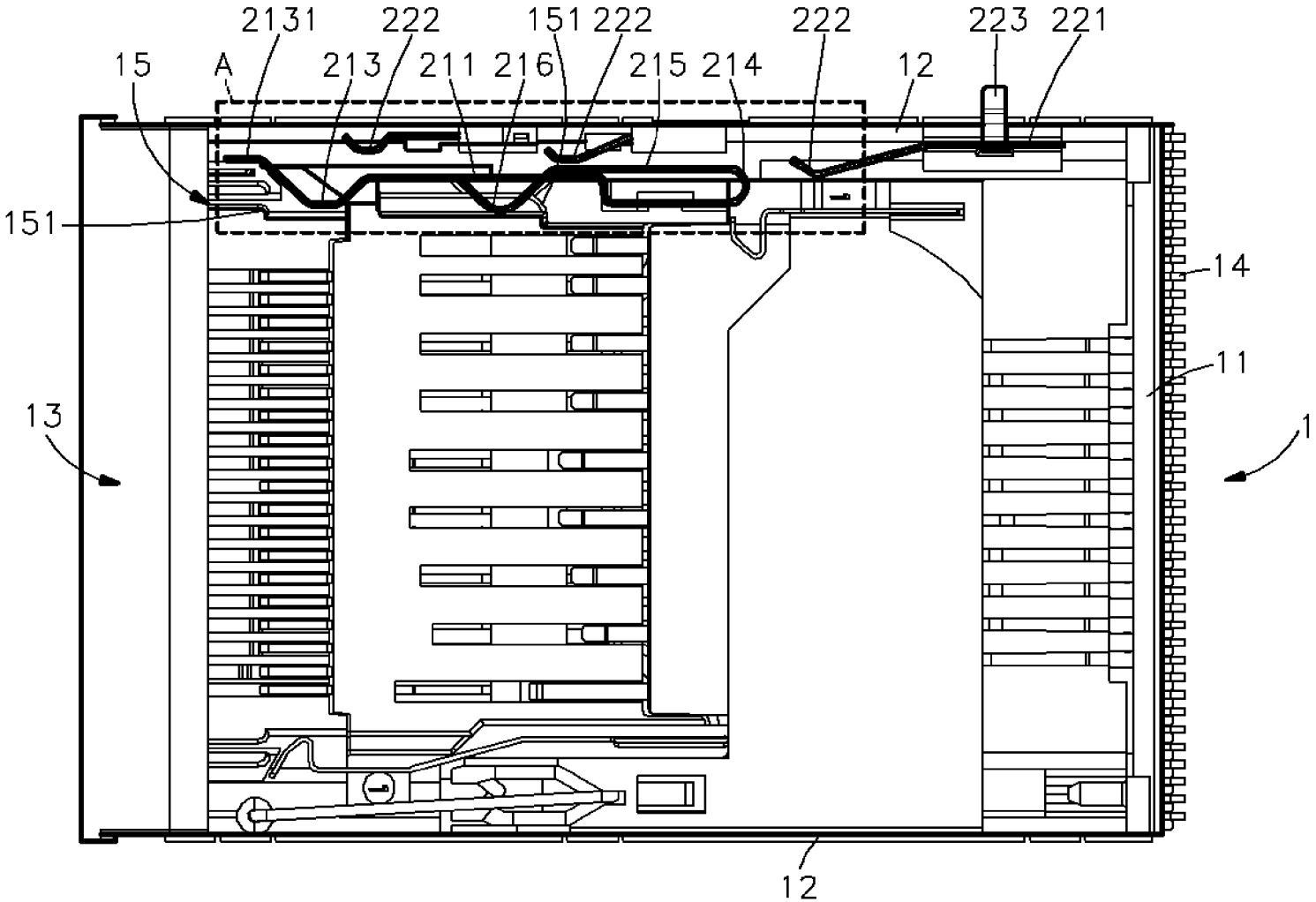
FIG. 3 is a top view of the present invention.

Please refer to FIGS. 1, 2 and 3, the monitoring module of the multi-card connector in accordance with the present invention comprises a electrically insulative housing 1 and a monitoring module 2.

The housing 1 comprises a base 11, two side arms 12 respectively extending from the base 11 at two sides in same direction, a receiving space 13 defined between two side arms 12 above the base 11 for receiving one of a variety of memory cards (not shown in the figure), terminals 14 mounted in the receiving space 13 for electrically connecting a contact point of one of a variety of memory cards insertable into the receiving space 13, and at least one sliding member 15 capable of reciprocally moving along lateral sides of the two side arms 12 and having at least one sliding surface 151 for pushing one of a variety of memory cards.

The monitoring module 2 is comprised of at least one common terminal 21 and a contact terminal 22, and the common terminal 21 and the contact terminal 22 are fixed respectively to the sliding member 15 and the side arm 12 nearby, and the common terminal 21 is integrally formed and has a base 211 at the center and a penetrating hole 212 on the base 211. A first pressing member 213 is continuously bent from one side of the base 211, a turning member 214 is bent from another side away from the first pressing member 213, and an elastic arm 215 is extended from one side of the turning member 214. A second pressing member 216 is continuously bent from an end of the elastic arm 215 and capable of being move reciprocally in the penetrating hole 212, and the ends of the first pressing member 213 and the second pressing member 216 include a contact member 2131, 2161. The contact terminal 22 includes a base 221, and a coupling member 222 is continuously bent from one side of the base 221 and a connecting end 223 is disposed on another side for connecting a detect circuit (not shown in the figures).

Figure 3A:
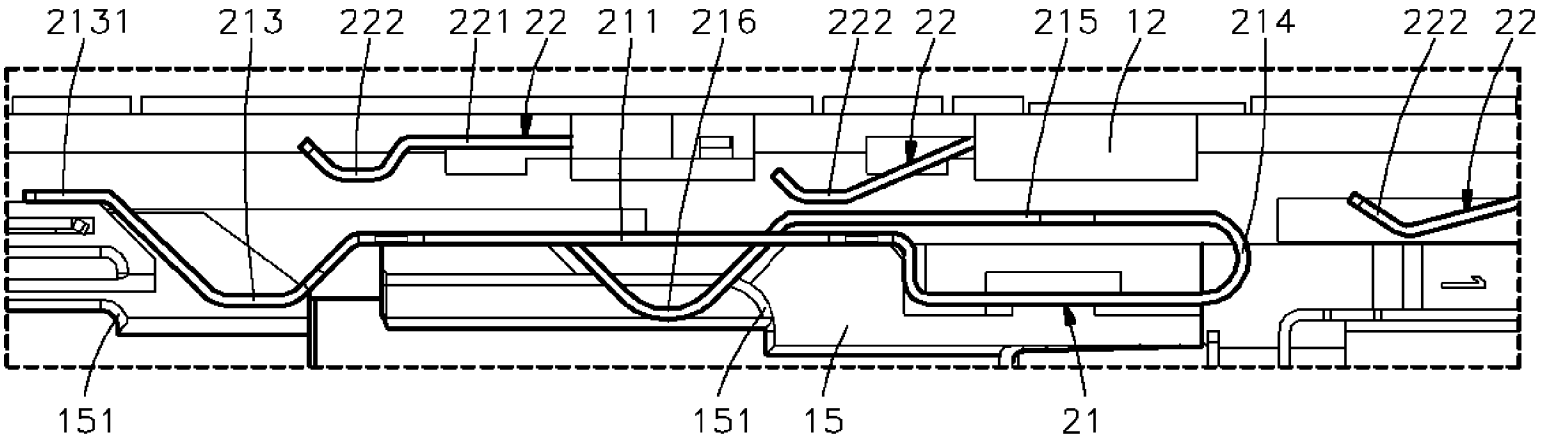
FIG. 3A is a top view of an enlarged section of the present invention.
Figure 4:
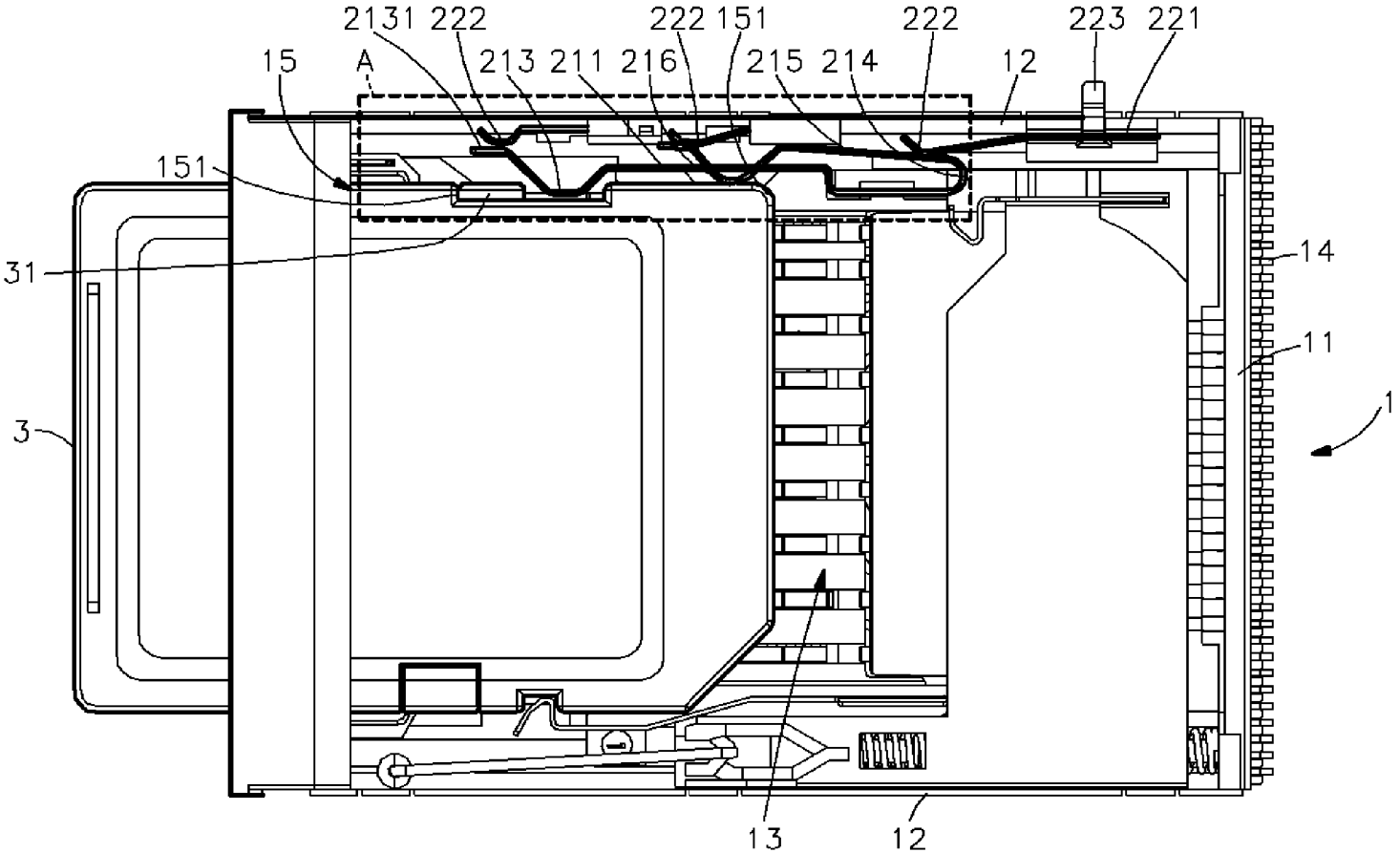
FIG. 4 is a top view of a memory card being inserted into the card connector according to the present invention.
Figure 4A:
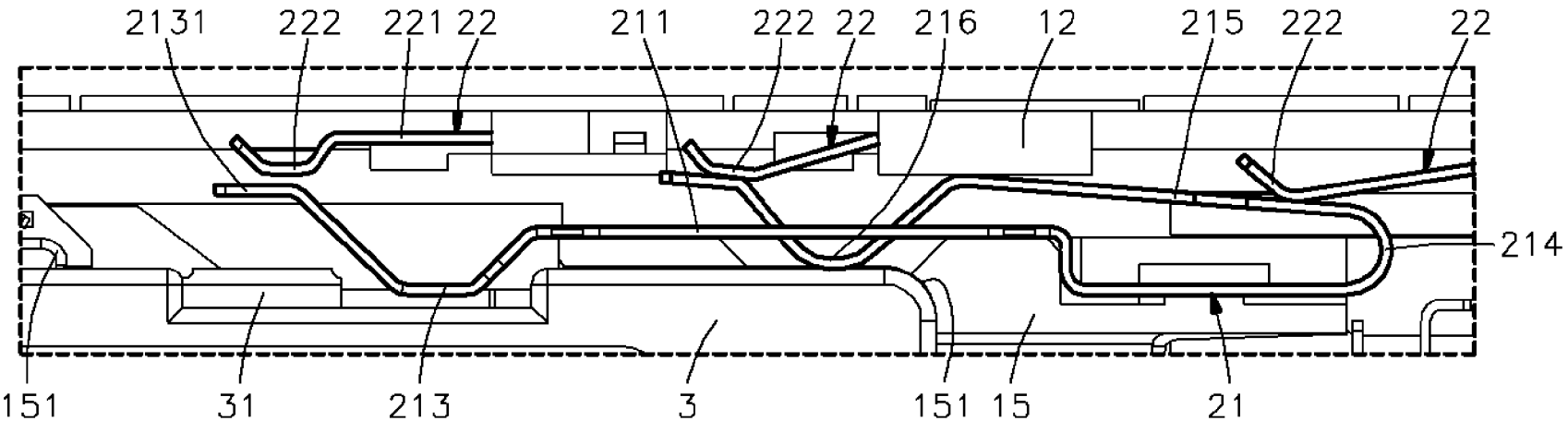
FIG. 4A is a top view of an enlarged section of a memory card being inserted into the card connector according to the present invention.
Figure 5:
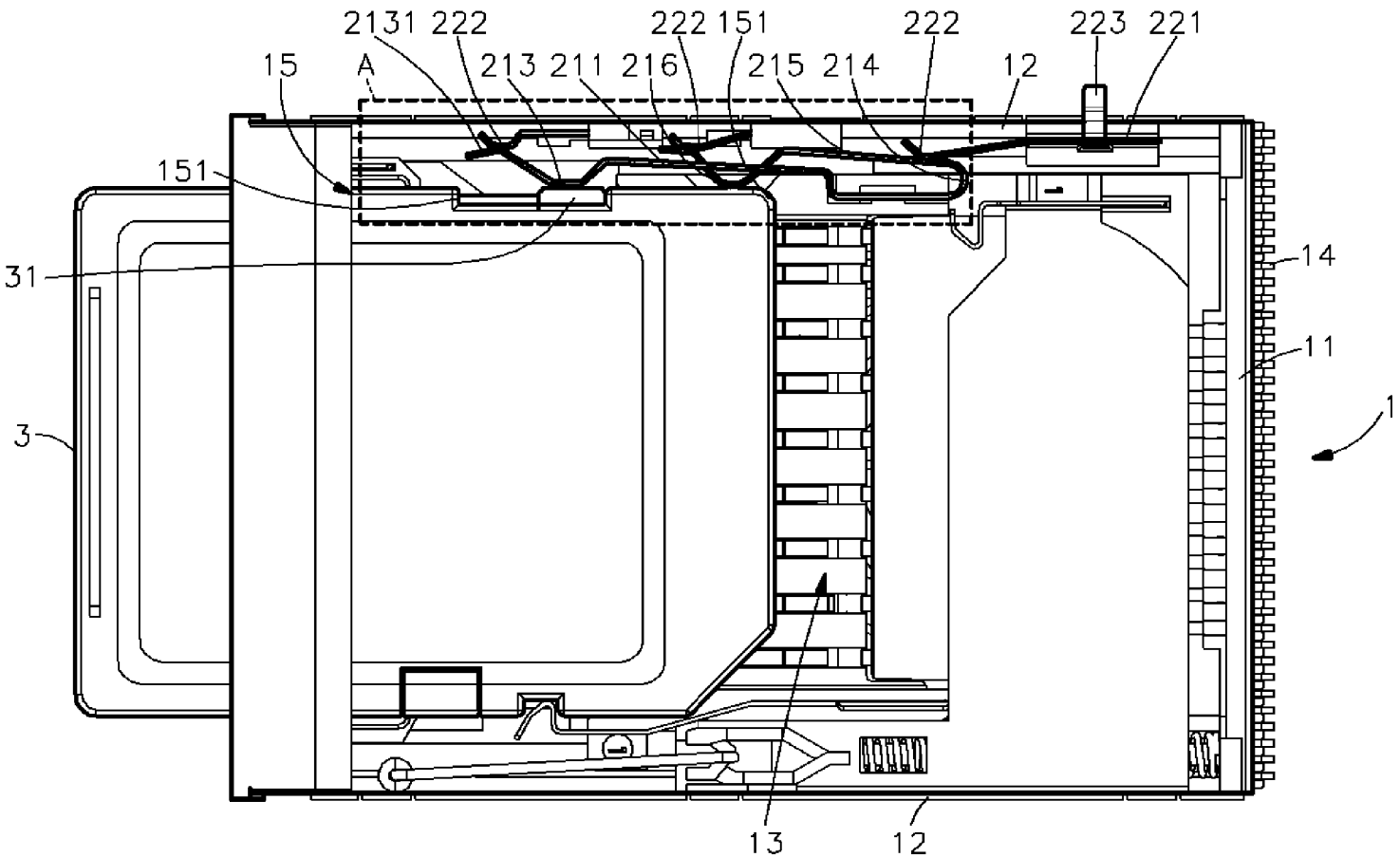
FIG. 5 is another top view of a memory card being inserted into the card connector according to the present invention.
Figure 5A:
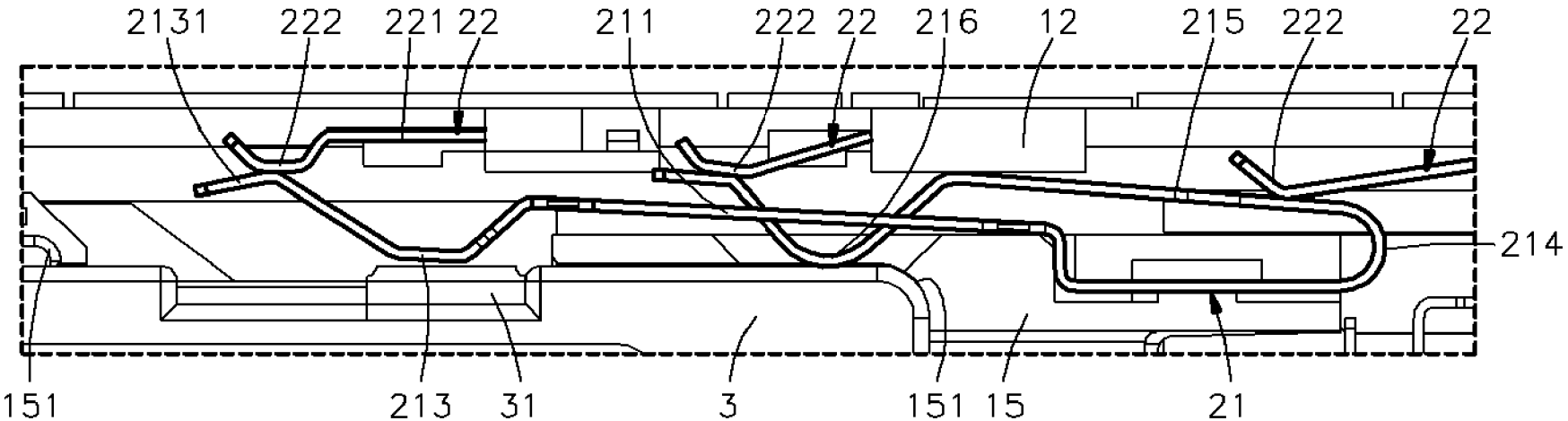
FIG. 5A is another top view of an enlarged section of a memory card being inserted into the card connector according to the present invention.

Please refer to FIGS. 3, 4 and 5, the common terminal 21 and the contact terminal 22 are fixed respectively to the sliding member 15 and the side arm 12 nearby, and the turning member 214 of the common terminal 21, the contact member 2161 of the second pressing member 216, and the contact member 2131 of the first pressing member 213 are corresponsive to the front of the coupling member 222 of each contact terminal 22 in sequence (as shown in FIGS. 3 and 3A). If a memory card 3 with a different specification is installed into the housing 1, the memory card 3 moves the sliding member 15 towards inward horizontally through the sliding surface 151, such that the turning member 214 of the common terminal 21 is in contact with the corresponding coupling member 222 of the contact terminal 22 for an electric connection, and further detecting whether or not the card connector and an electronic device form a loop (not shown in the figures). Further, the memory card 3 also presses against the second pressing member 216 of the common terminal 21 to drive the elastic arm 215 into an elastic deformation condition, and the contact member 2161 of the second pressing member 216 is electrically connected with another corresponding coupling member 222 of the contact terminal 22, so that the situation of the memory card 3 being installed at the correct position of the housing 1 can be detected. Further, the actual switch position of a read/write switch 31 disposed on one side of the memory card 3 is divided into a writable mode and a write-protect mode. If the read/write switch 31 is set to the writeable position (as shown in FIGS. 4 and 4A), the first pressing member 213 of the common terminal 21 will not press against the read/write switch 31, and the contact member 2131 cannot electrically connect with another corresponding coupling member 222 of the contact terminal 22. Therefore, data can be written into the memory card 3. If the read/write switch 31 is set to the write-protect position (as shown in FIGS. 5 and 5A), the first pressing member 213 of the common terminal 21 will be pressed by the read/write switch 31 to produce an elastic deformation, such that the contact member 2131 electrically connects with another corresponding coupling member 222 of the contact terminal 22 as to prevent data from being written into the memory card 3. Therefore, the common terminal 21 has the functions of concurrently detecting a circuit connection, a memory card installation and a write-protect function as to eliminate the installation of additional detecting terminal sets.

Further, if the foregoing memory card 3 is installed into the correct position of the housing 1, the contact point built on the memory card is electrically connected with the corresponding terminals 14 for data transmissions.

Therefore, the integrally formed common terminal 21 of the present invention provides the functions of concurrently detecting a circuit connection, a memory card installation and a write-protect function as the key points for the protection, and the common terminal 21 electrically connects the contact terminals 22 in sequence through the sliding member 15 as to reduce the space occupied by the additional terminal sets in the housing as well as the overall size of the card connector. The present invention makes the mass production of the integrally formed common terminals 21 much easier, without requiring two or more molds for the production as to lower the manufacturing cost of the card connector. The receiving space 13 of the housing 1 can be installed with one or more memory cards 3 of different specifications, and the memory cards 3 installed in the receiving space 13 include the formats of a multimedia card (MMC), a compact flash card (CF), a smart media card (SMC), a memory stick (MS), a secure digital memory card (SD), an extreme digital card (XD), and any combination of the above.

A prototype of multi-card connector has been constructed with the features of FIGS. 1 ~5A. The multi-card connector functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A monitoring module of multi-card connector, comprising a electrically insulative housing and a monitoring module, wherein said housing comprising a base, two side arms respectively extending from said base at two sides in same direction, a receiving space defined between said two side arms above the base for receiving a memory card, and a sliding member mounted in said receiving space and having a sliding surface, characterized in that:

said monitoring module comprises at least one common terminal and contact terminals being respectively fixed to said sliding member and said side arm nearby; said common terminal is integrally formed and includes a base having a penetrating hole at its center, a first pressing member continuously bent from one side of said base, a turning member bent from another side away from said first pressing member, an elastic arm extended from one side of said turning member, a second pressing member continuously bent from an end of said elastic arm and capable of moving reciprocally in said penetrating hole, and said first and second pressing members having a contact member at their ends respectively; thereby when a different memory card is inserted into said housing, said memory card moves said sliding member towards inward horizontally through said sliding surface, thereby said turning member of said common terminal, said contact member of said second pressing member and said contact member of said first pressing member are in contact with said corresponding contact terminals in sequence as to achieve the effects of concurrently detecting a circuit connection, a memory card installation, and a write-protect function.

2. The monitoring module of multi-card connector as claimed in claim 1, wherein said receiving space comprises terminals for electrically coupled with a contact point of different memory cards.

3. The monitoring module of multi-card connector as claimed in claim 1, wherein said contact terminal comprises a base, a coupling member being continuously bent from one side of said base, and a connecting end being disposed on the other side for detecting a circuit connection.

4. The monitoring module of multi-card connector as claimed in claim 1, wherein said receiving space further comprises at least one sliding member.

* * * * *